US008622640B2

(12) United States Patent
Sato et al.

(10) Patent No.: US 8,622,640 B2
(45) Date of Patent: Jan. 7, 2014

(54) PRINTING APPARATUS

(75) Inventors: Naoki Sato, Fukushima (JP); Takashi Nagakubo, Fukushima (JP)

(73) Assignee: Oki Data Corporation, Tokyo (JP)

( * ) Notice: Subject to any disclaimer, the term of this patent is extended or adjusted under 35 U.S.C. 154(b) by 471 days.

(21) Appl. No.: 12/578,675

(22) Filed: Oct. 14, 2009

(65) Prior Publication Data

US 2010/0098474 A1 Apr. 22, 2010

(30) Foreign Application Priority Data

Oct. 17, 2008 (JP) ..... 2008-268375

(51) Int. Cl.
*B41J 11/66* (2006.01)

(52) U.S. Cl.
USPC ..... 400/621; 400/76; 400/582; 347/218

(58) Field of Classification Search
USPC ..... 400/621
See application file for complete search history.

(56) References Cited

U.S. PATENT DOCUMENTS

| | | | | | |
|---|---|---|---|---|---|
| 4,925,325 | A * | 5/1990 | Niikawa | 400/621 |
| 4,926,191 | A * | 5/1990 | Takenaka et al. | 347/218 |
| 4,957,381 | A * | 9/1990 | Sakai et al. | 400/621 |
| 5,131,772 | A * | 7/1992 | Yamaguchi | 400/621 |
| 5,222,818 | A * | 6/1993 | Akiyama et al. | 400/621 |
| 2010/0060705 | A1 * | 3/2010 | Masuda | 347/218 |

FOREIGN PATENT DOCUMENTS

| | | | |
|---|---|---|---|
| JP | 63108747 | A | 5/1988 |
| JP | 10230658 | A | 9/1998 |
| JP | 2001-205871 | A | 7/2001 |
| JP | 2005319740 | A | 11/2005 |
| JP | 2009137277 | A | 6/2009 |

* cited by examiner

*Primary Examiner* — Jill Culler

(74) *Attorney, Agent, or Firm* — Panitch Schwarze Belisario & Nadel LLP

(57) ABSTRACT

A printing apparatus is supplied capable of printing without the occurrence of the slack of copying paper. The printing apparatus comprises a paper cut mechanism for cutting successive paper printed in a print mechanism; a first conveying section which holds and sends out successive paper to the print mechanism; a second conveying section which holds and sends out the successive paper that is printed out in the print mechanism and is sent out from the first conveying section to the paper cut mechanism; and a controlling section which returns a tip of the successive paper after being cut by the paper cut mechanism to between the print mechanism and the first conveying section.

19 Claims, 16 Drawing Sheets

1. JOB DATA EXPLANATION:

(a) " RECEIPT "

(b) (OMISSION)

(c) " *THANK YOU* "

(d) " xxxxxxxxxxxxxxxxxxxx "

"... Payless, Higher Quality... "

" Tel. x-xxxx.xxxx. x-xxxx-xxxx "

(e) AUTOMATIC CUT COMMAND

PRINTING APPARATUS

FIELD OF THE INVENTION

The invention relates to a printing apparatus capable of printing on copying paper.

BACKGROUND OF THE INVENTION

There is such conventional printing apparatus that accommodates roll paper into the inside, provides a cutter for cutting roll paper ejected after print, and prints by dividing print result into two of a submitting (issuing to a customer) use and preservation (shop safekeeping) use.

In such printing apparatuses, there is a printing apparatus that prints the same content respectively by using two rolls of 1P roll paper and that print and copies print content by using a roll of 2P roll paper as copying paper (for example, referring to patent document 1).

Patent document 1: Japan patent publication of No. 2001-205871 (paragraph [0013]-paragraph [0014], FIG. 1, FIG. 2)

However, in the conventional technology mentioned above, when one printing apparatus enables to print by using both of 1P roll paper and 2P roll paper, for conveying respective papers through the same paper route by inserting them between rollers, pressure between the rollers has to be set into the intermediate of necessary pressures so as to convey 1P roll paper or 2P roll paper. In such setting, in a printing apparatus without winding mechanism of paper, if print is continued by feeding 2P roll paper, only one side of pull-up rollers in the printing apparatus is driven, and then the slack of the paper occurs because one of the paper is pulled powerfully in comparison with the other of the paper. Thus, there is a problem that a running jam of paper occurs if the amount of the slack of the paper exceeds a certain amount.

SUMMARY OF THE INVENTION

It is, therefore, an object of the invention to provide a printing apparatus that can solve the above problem. That is, it is possible to print without the occurrence of the slack of copying paper.

An aspect of the invention is to provide a printing apparatus that has a paper cut mechanism for cutting successive paper printed in a print mechanism, comprising: a first conveying section which holds and sends out successive paper to the print mechanism; a second conveying section which holds and sends out the successive paper that is printed out in the print mechanism and is sent out from the first conveying section to the paper cut mechanism; and a controlling section which returns a tip of the successive paper after being cut by the paper cut mechanism to between the print mechanism and the first conveying section.

THE EFFECT OF THE PRESENT INVENTION

According to such printing apparatus of the present invention, an effect is obtained an effect that can print without the occurrence of the slack of copying paper.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Hereinbelow, it is to explain an embodiment of a printing apparatus of the present invention referring to figures.

Embodiment 1

Figure 1A:
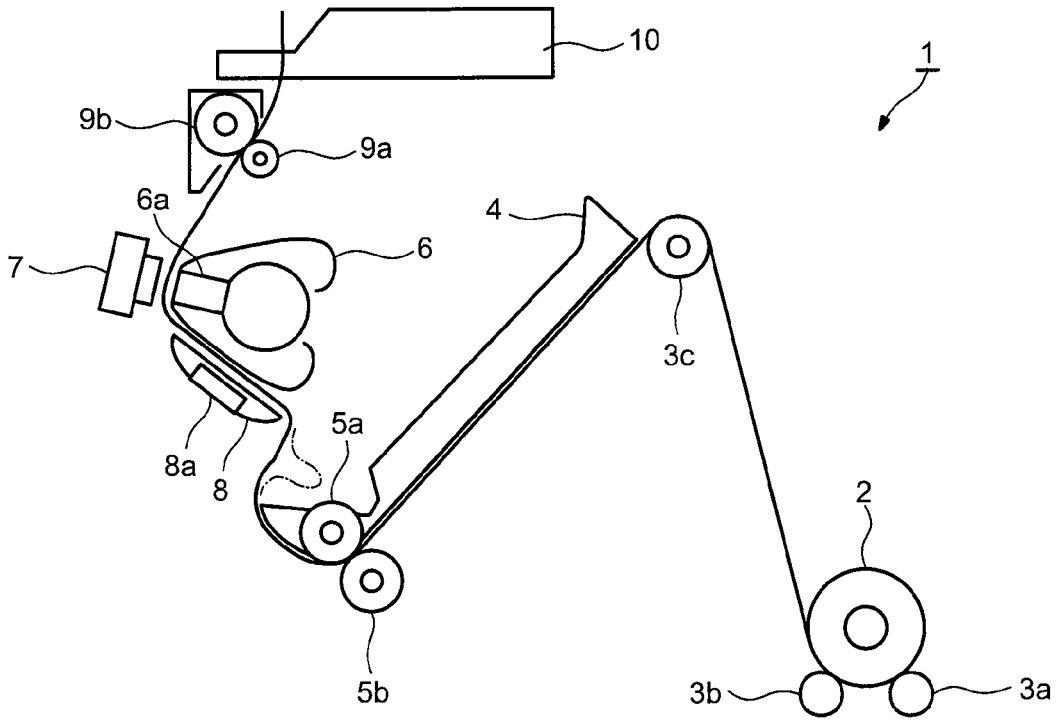
FIG. 1A is an explanation diagram showing a structure of a printing apparatus in the first embodiment.
Figure 1B:
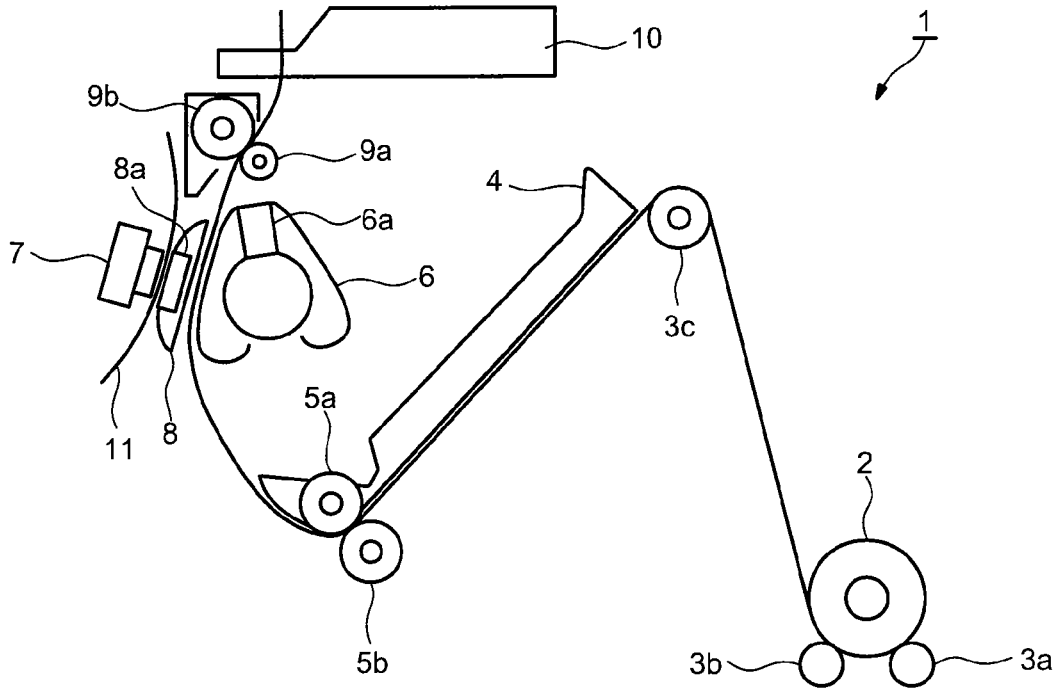
FIG. 1B is an explanation diagram showing a structure of a printing apparatus in the first embodiment.
Figure 2:
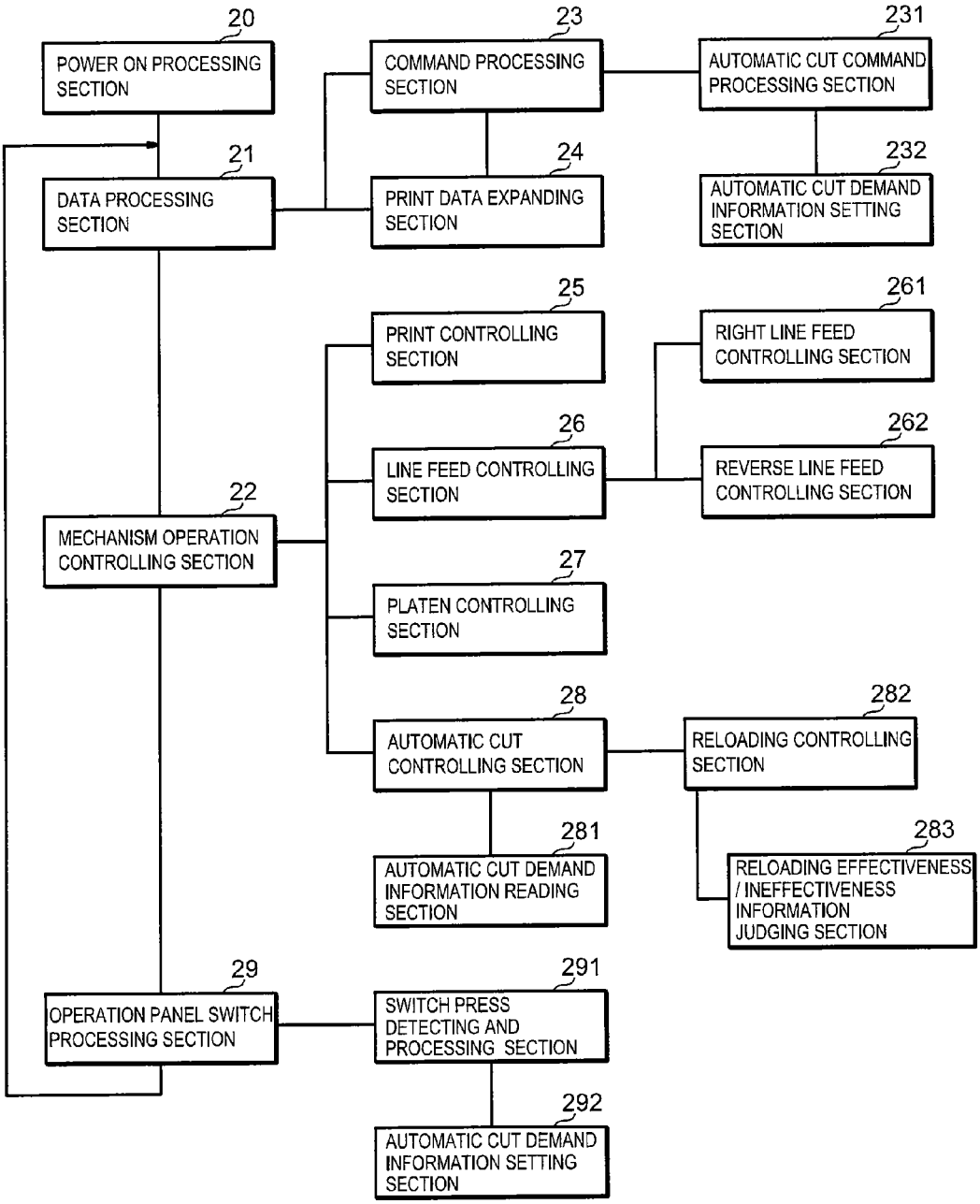
FIG. 2 is a block diagram showing a flow of a control of a printing apparatus in the first embodiment.

FIG. 1A is an explanation diagram showing a structure of a printing apparatus in the first embodiment; FIG. 1B is an explanation diagram showing a structure of a printing apparatus in the first embodiment; and FIG. 2 is a block diagram showing a flow of a control of a printing apparatus in the first embodiment.

In FIG. 1, 1 is a printing apparatus, and is an impact type printer such as a wire dot printer and the like that prints letters and the like on print paper such as copying journal paper and cut sheet paper.

2 is roll paper, which rolls journal paper as successive paper for printing in a printing apparatus 1. The present printing apparatus 1 can print on one sheet (1P) of journal paper and copying journal paper in which two sheets (2P) or over three sheets of journal paper are overlapped, but it is to explain to print on the 2P copying journal paper in the present embodiment.

3 (3*a*, 3*b*, 3*c*) are guide rollers, which are rollers for guiding the roll paper 2. A guide roller 3*a* and a guide roller 3*b* are furnished so as to touch circumference of the roll paper 2; and a guide roller 3*c* is furnished so as to moderate a warp of led out roll paper 2. Further, 4 is a guide member, which guides the led out roll paper 2.

5 (5*a*, 5*b*) are feed rollers as a first conveying section, which are for sending out the roll paper 2 guided through guide rollers 3 and the guide member 4 by inserting it between the feed rollers 5, and are constituted capable of rotating through a driving means such as a motor and the like (not shown). In the present embodiment, a feed roller 5*a* is constituted capable of rotating through a driving means; a feed roller 5*b* is furnished opposite to the feed roller 5*a* so as to contact the feed roller 5*a* in circumferences.

6 is a roll paper platen; 7 is a print head; which perform print as a printing mechanism on the roll paper 2 by abutting a print head 7 onto a abutment section 6*a* of the roll paper platen 6 through the roll paper 2.

8 is a cut sheet platen, which performs print as a printing mechanism on a cut sheet 11 by abutting the print head 7 onto a abutment section 8*a* of the cut sheet platen 8 through the cut sheet 11 inhaled from a cut sheet inhalation gate (not shown).

The roll paper platen 6 and the cut sheet platen 8 are axially supported by a rotation axis (not shown), and are constituted capable of rotating as one through a driving means such as a motor and the like (not shown). Hereinafter, the roll paper platen 6 and the cut sheet platen 8 are generically called a platen. FIG. 1A shows conditions in the case to print on the roll paper 2, in which, through rotating the platen, the roll paper platen 6 approaches the print head 7 while the cut sheet platen 8 is kept away from the print head 7. Further, FIG. 1B shows conditions in the case to print on the cut sheet 11, in which, through rotating the platen, the cut sheet platen 8 approaches the print head 7 while the roll paper platen 6 is kept away from the print head 7.

Figure 14:
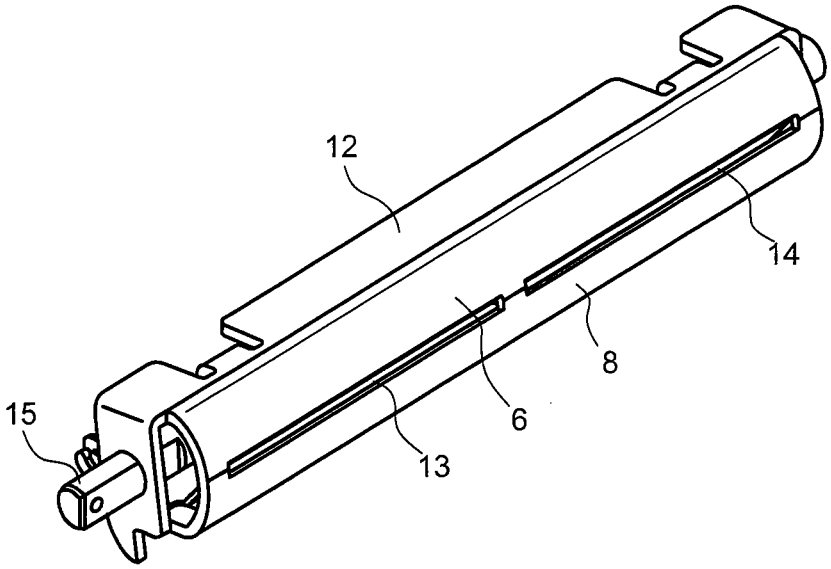
FIG. 14 is a squint diagram showing a platen.
Figure 15:
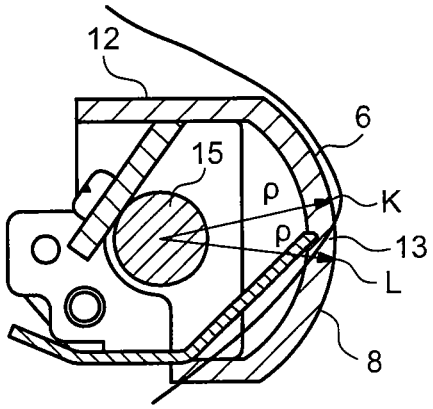
FIG. 15 is a section diagram showing a platen.

FIG. 14 is a squint diagram showing a platen; and FIG. 15 is a section diagram showing a platen.

In FIG. 14 and FIG. 15, a platen 12 is a single member, which is mechanically manufactured, for example, by steel materials, and has the roll paper platen 6 and the cut sheet platen 8. The abutment section 6*a* of the roll paper platen 6 and the abutment section 8*a* of the cut sheet platen 8 are opposite to the print head 7, have enough width capable of printing, and are formed into curve shapes. A slit gate 13 is a gate through which the roll paper 2 passes; a slit gate 14 is a pass gate of the cut sheet 11. The platen 12 has an axis 15, and can rotate on the axis 15 as the center.

In the inside of the platen 12, a paper guide 16 is formed, and a print paper 17 is guided that passes through the slit gate 13 or the slit gate 14. The abutment sections 6*a* and 8*a* have curve shapes, and those radii of curvature are equal to or larger than the radius ".rho." of curvature that passes two points K and L located at the upper limit of the slit gates 13 and 14.

With respect to conditions in the case to print on the cut sheet 11 that is shown by FIG. 1B, enough gap is formed between the roll paper platen 6 and the cut sheet platen 8, and it enables to convey the roll paper 2.

Figure 16:
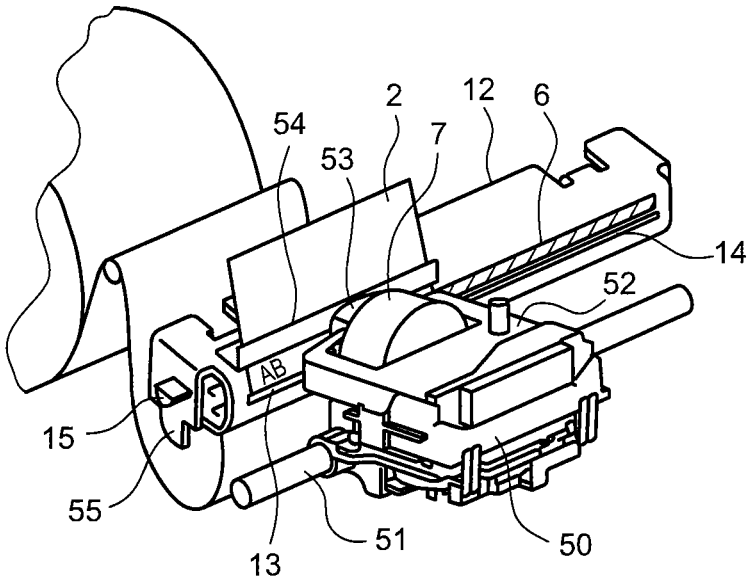
FIG. 16 is a first squint diagram showing a print head and a platen.
Figure 17:
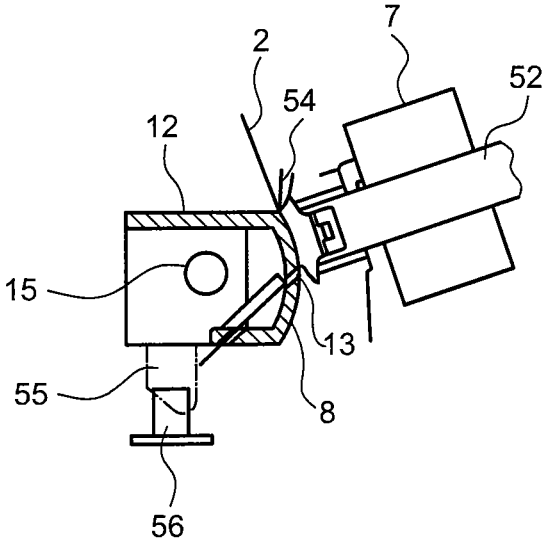
FIG. 17 is a first side diagram showing a print head and a platen.

FIG. 16 is a first squint diagram showing a print head and a platen; and FIG. 17 is a first side diagram showing a print head and a platen. With respect to both these figures, the print head 7 is furnished opposite to the abutment section 6*a* of the roll paper platen 6. The print head 7 moves back and forth in the spacing direction through a carriage 50 of self-propelled. The carriage 50 moves by being guided through a carriage shaft 51. A ribbon cassette 52 is installed around the print head 7, and a ribbon protect 53 is installed at the tip part of the print head 7. Further, a guiding section 54 which guides print paper is fixed at the upper part of the platen 12.

In FIG. 16 and FIG. 17, the roll paper 2 is installed as print paper; the roll paper 2 comes from the rear into the inside of the roll paper platen 6 by passing under the roll paper platen 6, goes out from the slit gate 13 to the outside of the roll paper platen 6, and is further conveyed to the above by passing the slit gate established in the guiding section 54. That is, the roll paper 2 is installed to stick to the abutment section 6*a* of the roll paper platen 6; at this time, the print head 7 is opposite to the abutment section 6*a*. Furthermore, at this time, as shown by FIG. 17, a detection use projection 55 established in the platen 12 crosses a transparency sensor 56.

Figure 18:
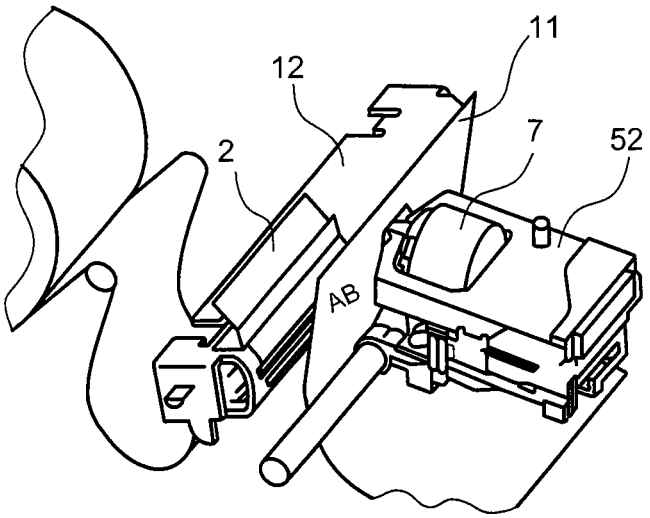
FIG. 18 is a second squint diagram showing a print head and a platen.
Figure 19:
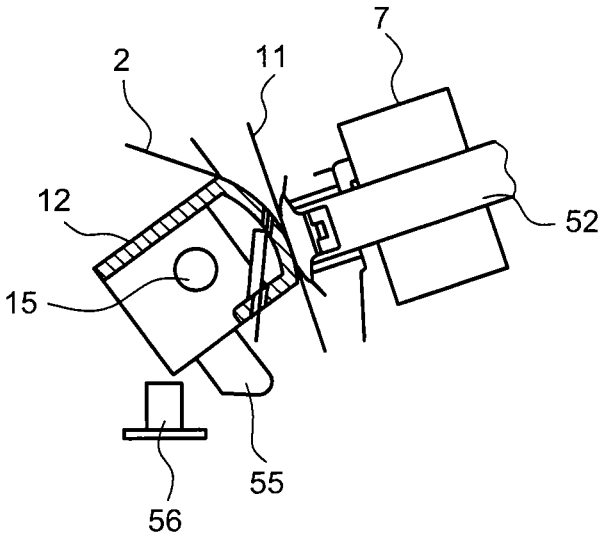
FIG. 19 is a second side diagram showing a print head and a platen.

FIG. 18 is a second squint diagram showing a print head and a platen; and FIG. 19 is a second side diagram showing a print head and a platen.

FIG. 18 and FIG. 19 shows a case in which the print head 7 is opposite to the abutment section 8*a* of the cut sheet platen 8. In FIG. 18 and FIG. 19, the roll paper 2 has been installed in the roll paper platen 6. On the conditions, the cut sheet 11 is installed between the print head 7 and the cut sheet platen 8. At this time, the print head 7 is opposite to the abutment section 8*a* of the cut sheet platen 8, and the cut sheet 11 and the roll paper 2 are arranged so that they are not overlapped at the print position. Further, at this time, the detection use projection 55 comes off the transparency sensor 56.

Returning to FIG. 1A and FIG. 1B, 9 (9*a*, 9*b*) are pull-up rollers as a second conveying section, which pull roll paper 2 printed by the roll paper platen 6 and the print head 7 (print mechanism) inside by inserting it between the pull-up roller, and are constituted capable of rotating through a driving means such as a motor and the like (not shown). In the present embodiment, a pull-up roller 9*a* is constituted capable of rotating through a driving means; a pull-up roller 9*b* is furnished opposite to the pull-up roller 9*a* so as to contact the pull-up roller 9*a* in circumferences.

10 is an automatic cutter as a paper cut mechanism, which cuts the roll paper 2 sent out through the pull-up roller 9. The automatic cutter 10 can cut the roll paper 2 by being driven through a drive means such as solenoid and the like (not shown).

Moreover, in the printing apparatus 1, a switch operated by an operator (not shown) is furnished, and it is constituted capable of detecting an operation for making an automatic cut operation of the roll paper 2 start.

The printing apparatus 1 is constituted like this, capable of printing on the roll paper 2 or the cut sheet 11.

With respect to FIG. 2, 20 is a power-on processing section; when a power source is switched on in the printing apparatus 1, after initialization operations of respective information stored in storing section such as a memory and the like and mechanism are performed, a data processing section 21, a mechanism operation controlling section 22, and an operation panel switch processing section 29 work cyclically.

A data processing section 21 is composed of a command processing section 23 and a print data expanding section 24, an analyzes data sent from an upper apparatus (not shown). The command processing section 23, for example, sets (stores) information of a line feed demand and a line feed amount/direction in a storing section in the case of a line feed command, and sets a print demand in a storing section in the case of a line area cutting command. Further, the command processing section 23 has an automatic cut command processing section 231, and an automatic cut demand information setting section 232 of the automatic cut command processing section 231 sets an automatic cut demand information for starting cutting operation of the roll paper 2 through the automatic cutter 10 into a storing section in the case of an automatic cut command.

Furthermore, a print data expanding section 24 performs a process that expands the print data for printing that is sent.

A mechanism operation controlling section 22 is composed of a print controlling section 25, a line feed controlling section 26, a platen controlling section 27 and an automatic cut controlling section 28. The print controlling section 25 performs a print operation on the basis of the print demand set into the storing section of the command processing section 23; the line feed controlling section 26 performs a line feed operation that sends the roll paper 2 on the basis of information of the line feed demand and the line feed amount/direction set into the storing section of the command processing section 23; the platen controlling section 27 performs a rotation operation of the roll paper platen 6 and the cut sheet platen 8; and the automatic cut controlling section 28 performs a cutting operation of the roll paper 2 on the basis of the automatic cut demand information setting section 232.

An operation panel switch processing section 29 has a switch press detecting and processing section 291, and detects that a switch is pressed for making an automatic cut of the roll paper 2 start through an operator, and then after the pressure of the switch is detected, an automatic cut demand information setting section 292 sets automatic cut demand information for making a cutting operation of the roll paper 2 start into a storing section.

The line feed controlling section 26 is composed of a right line feed controlling section 261 and a reverse line feed controlling section 262. On the basis of information of the line feed demand and the line feed amount/direction set into the storing section, the right line feed controlling section 261 performs a right line feed operation that sends out the roll paper 2 from the feed roller 5 to the direction (hereinafter, "a right direction") of the pull-up roller 9; and the reverse line feed controlling section 262 performs a reverse line feed operation that pulls back the roll paper 2 from the pull-up roller 9 to the direction (hereinafter, "a reverse direction") of the feed roller 5.

The platen controlling section 27 performs a control that makes the roll paper platen 6 and the cut sheet platen 8 move corresponding to kinds of paper to print, that is, the roll paper 2 or the cut sheet 11.

Here, it is to explain a control that makes the roll paper platen 6 and the cut sheet platen 8 move on the basis of FIG. 1.

On the one hand, when the roll paper 2 is printed, as shown by FIG. 1A, FIG. 16 and FIG. 17, the roll paper 2 comes from the rear of the roll paper platen 6 into between the roll paper platen 6 and the cut sheet platen 8 by passing under the roll paper platen 6, and is further conveyed to the above by passing the slit gate between the roll paper platen 6 and the cut sheet platen 8. That is, the roll paper 2 is installed to stick to the abutment section 6*a* of the roll paper platen, at this time, the print head 7 I opposite to the abutment section 6*a*. Furthermore, at this time, the detection use projection 55 of the roll paper platen 6 crosses the transparency sensor 56, and detects that the abutment section 6*a* is opposite to the print head 7.

On the other hand, when the cut sheet 11 is printed, and the roll paper 2 is inhaled, as shown by FIG. 1B, FIG. 18 and FIG. 19, by making the roll paper platen 6 and the cut sheet platen 8 rotate, the abutment section 8*a* of the cut sheet platen 8 is moved to the opposite position of the print head 7. On the conditions, the cut sheet 11 is installed to stick to the abutment section 8*a* of the cut sheet platen 8; and even though the roll paper 2 is kept between the roll paper platen 6 and the cut sheet platen 8, the cut sheet 11 and the roll paper 2 are arranged so that they are not overlapped at the print position.

Furthermore, even when the roll paper 2 is inhaled from the feed roller 5 to between the roll paper platen 6 and the cut sheet platen 8, and is conveyed to the pull-up roller 9, by making the roll paper platen and the cut sheet platen 8 rotate, the abutment section 8*a* of the cut sheet platen is moved to the opposite position of the print head 7 so that the roll paper 2 is nearly in a straight line from the neighborhood of the feed roller 5 to the pull-up roller 9. After the roll paper 2 is inhaled, when the roll paper 2 is printed, as shown by FIG. 1A, FIG. 16 and FIG. 17, by making the roll paper platen 6 and the cut sheet platen 8 rotate, the abutment section 6*a* of the roll paper platen 6 is moved to the opposite position of the print head 7.

Returning to the explanation of FIG. 2, the automatic cut controlling section 28 is composed of an automatic cut demand information reading section 281 and a reloading controlling section 282, reads out the automatic cut demand information set into a storing section through the automatic cut demand information reading section 281, when the automatic cut is demanded, performs a cutting operation of the roll paper 2 by making the automatic cutter 10 drive, then the reloading controlling section 282 once returns the tip of the roll paper 2 to a reverse direction only a fixed movement amount, and performs a reloading operation that sends out the tip of the roll paper 2 to the original position again. It is possible to remove the slack of the roll paper 2 through the reloading operation.

Moreover, the occurrence of the slack that is a problem point of the conventional technology is brought out only in the case to use 2P paper, the operation panel switch enables to previously select an effectiveness/ineffectiveness of the reloading operation for removing the slack through a menu function and the like (not shown), and the operation panel switch processing section 29 makes the selected effectiveness/ineffectiveness store in a storing section as reloading effectiveness/ineffectiveness information. Then, a reloading effectiveness/ineffectiveness information judging section 283 of the reloading controlling section 282 performs a judgment of the reloading effectiveness/ineffectiveness information before the reloading operation is started, and performs reloading operation only in the case of effectiveness.

The printing apparatus 1 is constituted like this, and stores a control program for controlling the whole printing apparatus 1 in a storing section such as a memory and the like (not shown), and on the basis of the control program, a control means such as CPU controls the whole printing apparatus 1.

Figure 3:
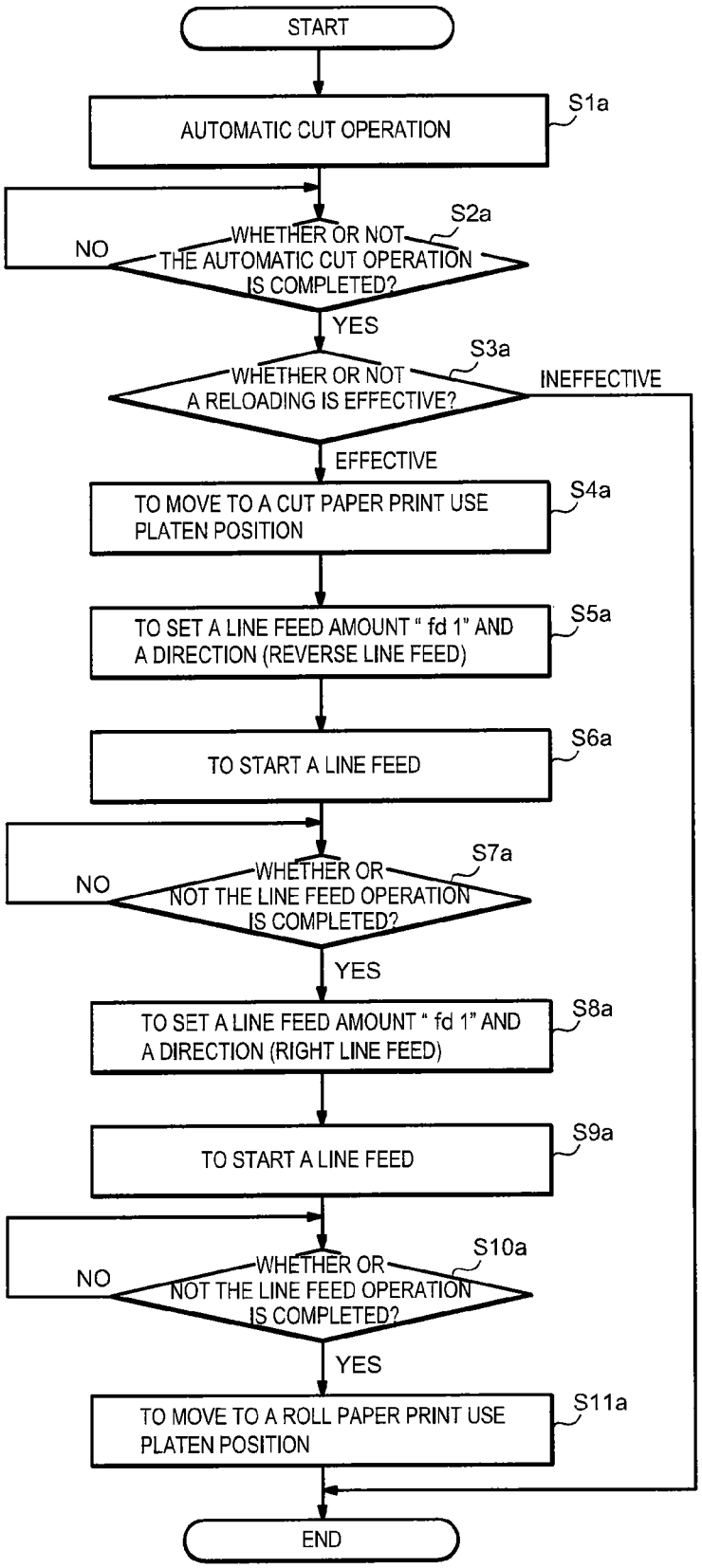
FIG. 3 is a flow chart for explaining a slack removing operation in the first embodiment.

It is to explain a function of the structure mentioned above by following steps shown by "S" of the flow chart for explaining a slack removing operation in the first embodiment of FIG. 3.

Figures 4A, 4B, 4C:
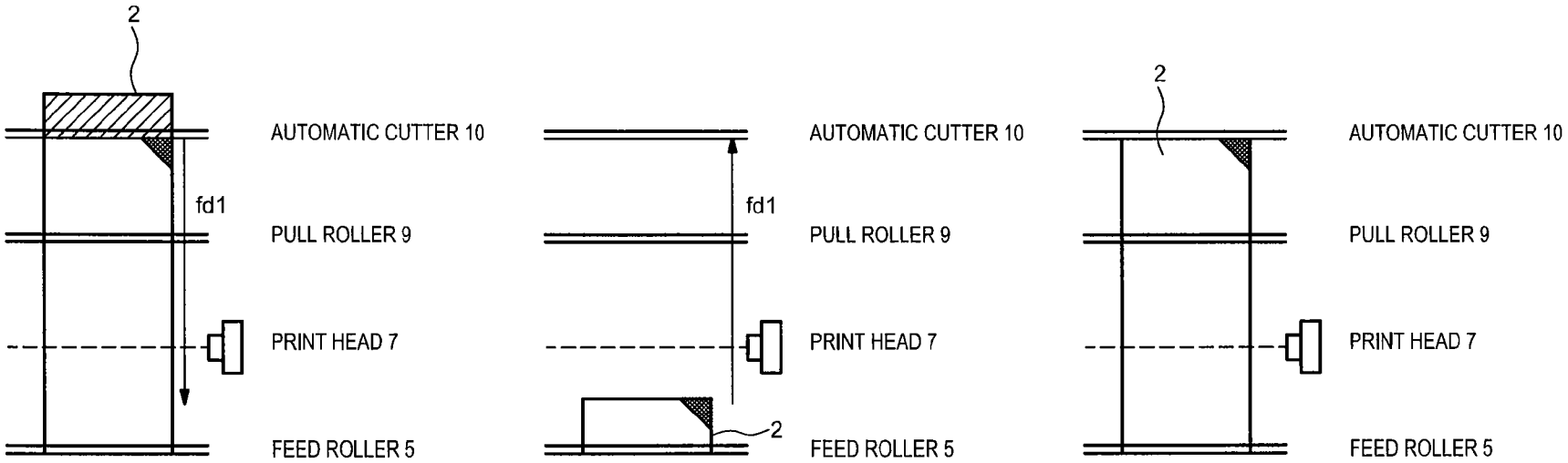
FIG. 4A is an explanation diagram showing a slack removing operation in the first embodiment.
FIG. 4B is an explanation diagram showing a slack removing operation in the first embodiment.
FIG. 4C is an explanation diagram showing a slack removing operation in the first embodiment.

S1*a*: When a print on the roll paper 2 is completed as shown by FIG. 4A, and the printed part is in a state that goes beyond the automatic cutter 10, the printing apparatus 1 receives an automatic cut command from an upper apparatus, or a switch is pressed for starting an automatic cut through an operator, and automatic cut demand information is stored in a storing section.

The automatic cut demand information reading section 281 of the automatic cut controlling section 28 reads out the automatic cut demand information stored in the storing section, and starts an operation (automatic cut operation) for cutting the roll paper 2 through the automatic cutter 10 by driving a driving means.

S2*a*: After the automatic cut controlling section 28 performs a cutting operation through the automatic cutter 10, a tip part (the shaded portion in the figure) of the roll paper 2 shown by FIG. 4A is cut, furthermore, an operation is performed for returning the automatic cutter 10 to the initial position, then after the operation is completed, the process is shifted to S1*a*.

S3*a*: After the roll paper 2 is cut, the reloading effectiveness/ineffectiveness information judging section 283 of the reloading controlling section 282 reads out and judges the reloading effectiveness/ineffectiveness information stored previously in a storing section, after judged it ineffective, completes the process; after judged it effective, on the other hand, shifts the process to S4*a*.

S4*a*: After the reloading effectiveness/ineffectiveness information is judged to be effective, the platen controlling section 27, as shown by FIG. 1B, moves the abutment section 8*a* of the cut sheet platen 8 to the opposite position of the print head 7 (cut sheet print use platen position) by rotating the roll paper platen 6 and the cut sheet platen 8 so that the roll paper 2 is nearly in a straight line from the neighborhood of the feed roller 5 to the pull-up roller 9.

S5*a*: After the roll paper platen 6 and the cut sheet platen 8 are moved, the line feed controlling section 26 makes a line feed amount ("fd1") and a direction (reverse line feed) store in a storing section.

S6*a*: After the line feed amount ("fd1") and the direction (reverse direction) are stored in the storing section, the reverse line feed controlling section 262 reversely feeds lines in the roll paper 2 on the basis of the line feed amount ("fd1").

S7*a*: The reverse line feed controlling section 262, as shown by FIG. 4B, performs the reverse line feed operation that feeds lines in the reverse direction until the tip of the roll paper 2 reaches to the position between the print head as a print mechanism and the feed roller 5, after the reverse line feed operation is completed, the process is shifted to S8*a*.

Thus, through taking off the tip of the roll paper 2 from the pull-up roller 9 and returning the tip of the roll paper 2 on the side of the feed roller from a position at which the slack (shown by a chain line in FIG. 1A) occurs between the print head 7 and the feed roller 5, it is possible to make the roll paper be in a state without the slack, similar to when the roll paper 2 is inhaled.

S8*a*: After the reverse line feed operation is completed, the line feed controlling section 26 makes a line feed amount ("fd1") and a direction (right direction) store in a storing section.

S9*a*: After the line feed amount ("fd1") and the direction (right direction) are stored in the storing section, the right line feed controlling section 261 feeds lines right in the roll paper 2 on the basis of the line feed amount ("fd1").

S10*a*: The right line feed controlling section 261, as shown by FIG. 4C, performs the right line feed operation that feeds lines in the right direction until the tip of the roll paper 2 reaches to the position of the automatic cutter beyond the pull-up roller 9, after the right line feed operation is completed, the process is shifted to S11*a*.

S11*a*: After the right line feed operation is completed, the platen controlling section 27, as shown by FIG. 1A, moves the abutment section 6*a* of the roll paper platen to the opposite position of the print head 7 (roll paper print use platen position) by rotating the roll paper platen 6 and the cut sheet platen 8, and the reloading operation is completed.

Like this, the printing apparatus 1 performs the reloading operation after the automatic cut operation, and performs the operation for removing the slack of paper.

Moreover, in the present embodiment, an effectiveness/ineffectiveness of the reloading is set through an operation of an operator, but it may be set that the reloading is effective in the case that the roll paper 2 is judged to be 2P paper, after it is judged whether the roll paper 2 is 1P paper or 2P paper by detecting paper thickness through a paper thickness detection mechanism (not shown).

Further, in the present embodiment, the reloading operation is performed after the automatic cut operation is performed through the automatic cut command and the like, but it may also perform the reloading operation per print of a fixed length (for example, 1 meter).

As explained above, in the first embodiment, in the case that print is performed by using 2P roll paper, through performing a reloading operation after an automatic cut operation is performed regularly in the printing apparatus used for a register of shop and the like, it is possible to remove the slack occurred through the successive performed print operation without accumulation, and an effect is obtained that can prevent the occurrence of a paper running jam.

Further, because the reloading operation for removing the slack of paper is performed after the automatic cut operation of roll paper, an effect is obtained that issue of receipts are made to customers without being late.

Embodiment 2

A second embodiment controls so as to make a margin of the tip part of roll paper little. It is to explain a structure of the second embodiment on the basis of a block diagram showing a flow of a control of a printing apparatus in the second embodiment of FIG. 5. Moreover, with respect to the same parts as the first embodiment mentioned above, the explanation is omitted by assigning the same marks.

Figure 5:
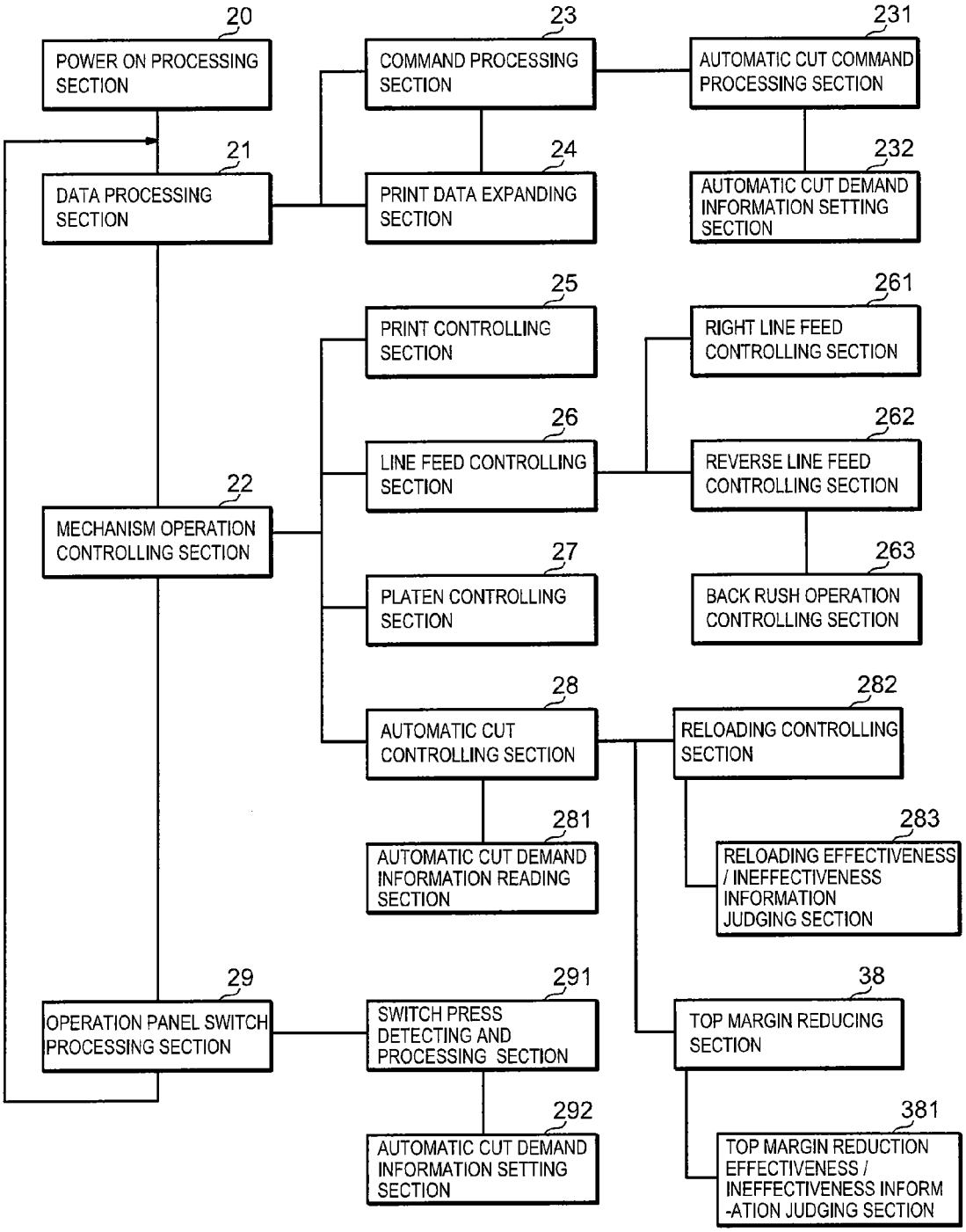
FIG. 5 is a block diagram showing a flow of a control of a printing apparatus in the second embodiment.

In the FIG. 5, the automatic cut controlling section 28 is composed of an automatic cut demand information reading section 281, a reloading controlling section 282, a reloading effectiveness/ineffectiveness information judging section 283, a top margin reducing section 38 and a top margin reduction effectiveness/ineffectiveness information judging section 381, and the top margin reducing section 38 controls so as to make a margin of the tip part of the roll paper 2 little by returning the roll paper 2 in a reverse direction after the automatic cut process of the roll paper 2.

An operation panel switch enables to previously select an effectiveness/ineffectiveness of a top margin reduction operation that makes the tip part of the roll paper 2 little through a menu function and the like (not shown); the selected effectiveness/ineffectiveness is made to store in a storing section as top margin reduction effectiveness/ineffectiveness information; and the top margin reduction effectiveness/ineffectiveness information judging section 381 of the top margin reducing section 38 performs a judgment of the top margin reduction effectiveness/ineffectiveness information before the top margin reduction operation is started, and performs the top margin reduction operation only in the effective case.

Further, with respect to the top margin reduction operation, a back rush operation controlling section 263 that performs an operation for canceling the print shrink of the first line in the next print operation is included in the reverse line feed controlling section 262.

Figure 6:
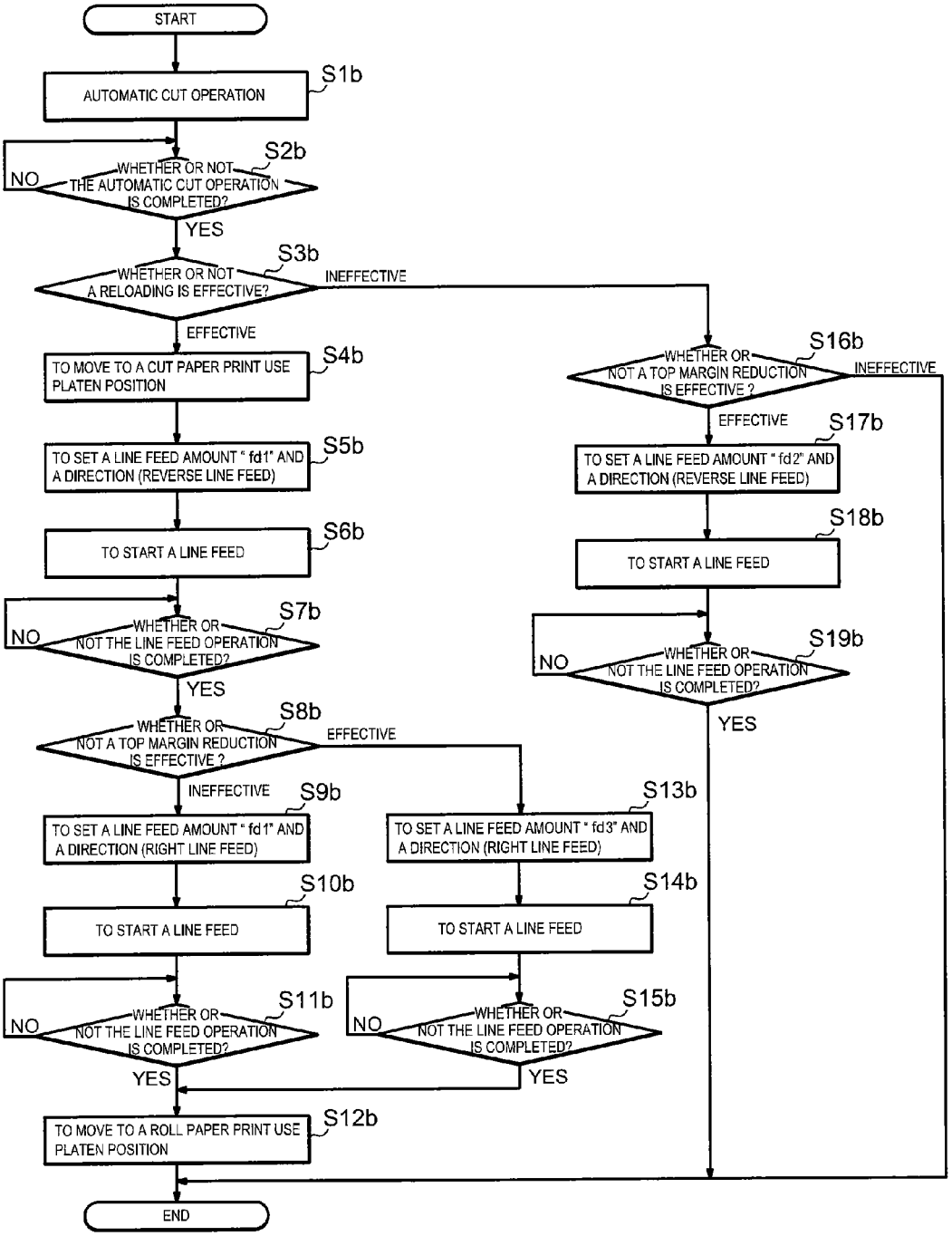
FIG. 6 is a flow chart for explaining a slack removing operation in the second embodiment.

It is to explain a function of the structure stated above by following steps shown by "S" of the flow chart for explaining slackens obtainment operation in the second embodiment of FIG. 6.

S1*b*, S2*b*: Because they are the same as S1*a* and S2*a* in FIG. 3, the explanation is omitted.

S3*b*: After cut the roll paper 2, the reloading effectiveness/ineffectiveness information judging section 283 of the reloading controlling section 282 reads out and judges reloading effectiveness/ineffectiveness information stored previously in a storing section, after judged it ineffective, shifts the process to S16*b*; after judged it effective, on the other hand, shifts the process to S4*b*.

S4*b*~S7*b*: Because they are the same as S4*a*~S7*a* in FIG. 3, the explanation is omitted.

S8*b*: After the reverse line feed operation is completed, the top margin reduction effectiveness/ineffectiveness information judging section 381 of the top margin reducing section 38 reads out and judges top margin reduction effectiveness/ineffectiveness information stored previously stored in a storing section, after judged it ineffective, shifts the process to S9*b*; after judged it effective, on the other hand, shifts the process to S13*b*.

S9*b*~S12*b*: Because they are the same as S8*a*~S11*a* in the FIG. 3, the explanation is omitted.

S13*b*: After it is judged that the top margin reduction effectiveness/ineffectiveness information is effective, the line feed controlling section 26 makes a line feed amount ("fd3") and a direction (right direction) store in a storing section.

Figure 7A:
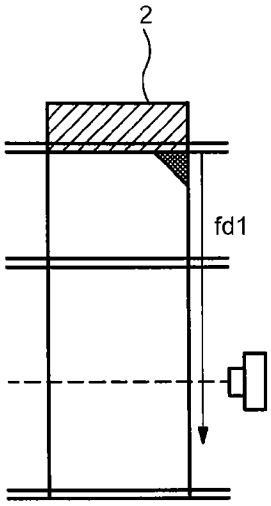
FIG. 7A is an explanation diagram showing a slack removing operation in the second embodiment.
Figure 7B:
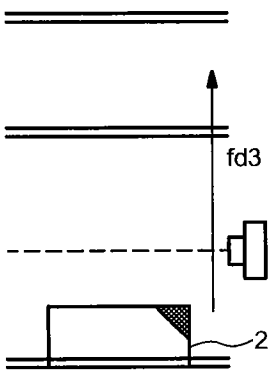
FIG. 7B is an explanation diagram showing a slack removing operation in the second embodiment.
Figure 7C:
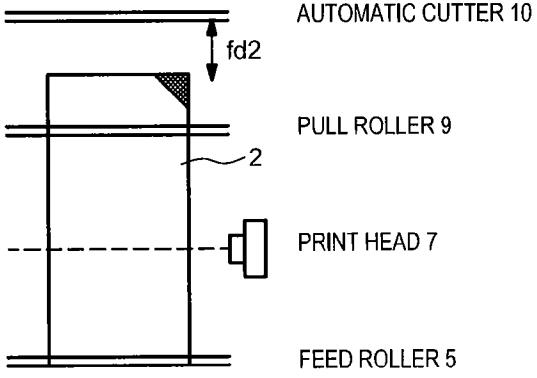
FIG. 7C is an explanation diagram showing a slack removing operation in the second embodiment.

The step is a process in which the reloading operation and the top margin reduction operation are effective together, "fd3" that is set as a line feed amount, is a value reduced a return line feed amount ("fd2") of the roll paper 2 in the top margin reduction in FIG. 7C from a sending line feed amount ("fd1") of the roll paper 2 in the reloading operation shown by FIG. 7A, that is, fd3=fd1fd2 (sending line feed amount "fd1">return line feed amount "fd2").

S14*b*: After the line feed amount ("fd3") and the direction (right direction) are stored in the storing section, the right line feed controlling section 261 feeds lines right in the roll paper 2 on the basis of the line feed amount ("fd3").

S15*b*: The right line feed controlling section 261, as shown by FIG. 7C, performs the right line feed operation (right line feed operation that returns the tip of the roll paper 2 at least to the pull-up roller 9) that feeds lines in the right direction until the tip of the roll paper 2 reaches to the position at which it is not taken off from the pull-up rollers 9, after the right line feed operation is completed, the process is shifted to S12*b*.

S16*b*: After it is judged that the reloading effectiveness/ineffectiveness information is ineffective in the S3*b*, the top margin reduction effectiveness/ineffectiveness information judging section 381 of the top margin reducing section 38 reads out and judges the top margin reduction effectiveness/ineffectiveness information stored previously in the storing section, after judged it ineffective, completes the process; after judged it effective, on the other hand, shifts the process to S17*b*.

S17*b*: After it is judged that the top margin reduction effectiveness/ineffectiveness information is effective, the line feed controlling section 26 makes a line feed amount ("fd2") and a direction (reverse direction) store in a storing section.

Figure 8B:
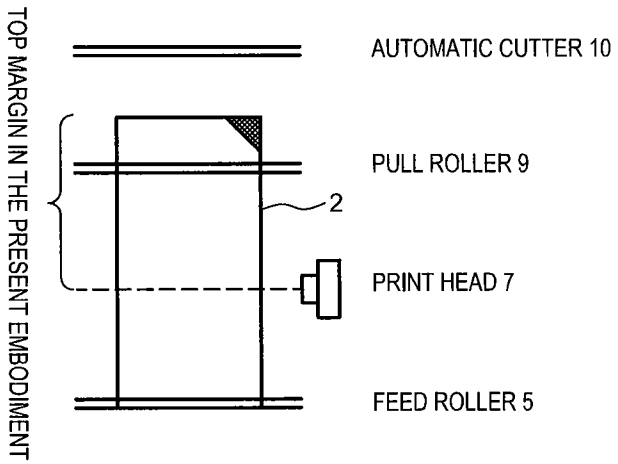
FIG. 8B is an explanation diagram showing a slack removing operation in the second embodiment.
Figure 8A:
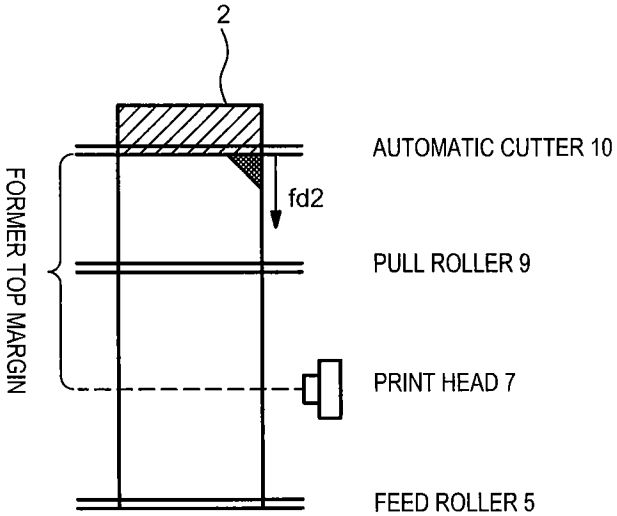
FIG. 8A is an explanation diagram showing a slack removing operation in the second embodiment.

S18*b*: After the line feed amount ("fd2") and the direction (reverse direction) are stored in the storing section, the reverse line feed controlling section 262 feeds lines reversely in the roll paper 2 from the position at which the tip part (the shaded portion in the figure) of the roll paper 2 shown by FIG. 8A is cut on the basis of the line feed amount ("fd2").

S19*b*: The reverse line feed controlling section 262, as shown by FIG. 8B, performs the reverse line feed operation until the tip of the roll paper 2 reaches to the position at which it is not taken off from the pull-up rollers 9, after the reverse line feed operation is completed, the process is completed.

Like this, the printing apparatus 1 controls so as to make the margin of the tip part of the roll paper 2 little.

As explained above, in the second embodiment, adding to the effect of the first embodiment, through performing the top margin reduction operation in the reloading operation performed after the automatic cut operation, an effect is obtained that can decrease the margin of the upper end part of paper.

Further, an effect is obtained that can reduce costs of paper by decreasing the margin.

Embodiment 3

A third embodiment prevents executing top margin reduction operations successively. In the second embodiment, there is a possibility that, after a switch for starting an automatic cut is pressed through a mistake of an operation just after the top margin reduction operation is completed, the roll paper is taken off from the pull-up rollers, and then a roll paper shrink occurs because the roll paper cannot be conveyed smoothly. This is for preventing the occurrence of the roll paper shrink.

Figure 9:
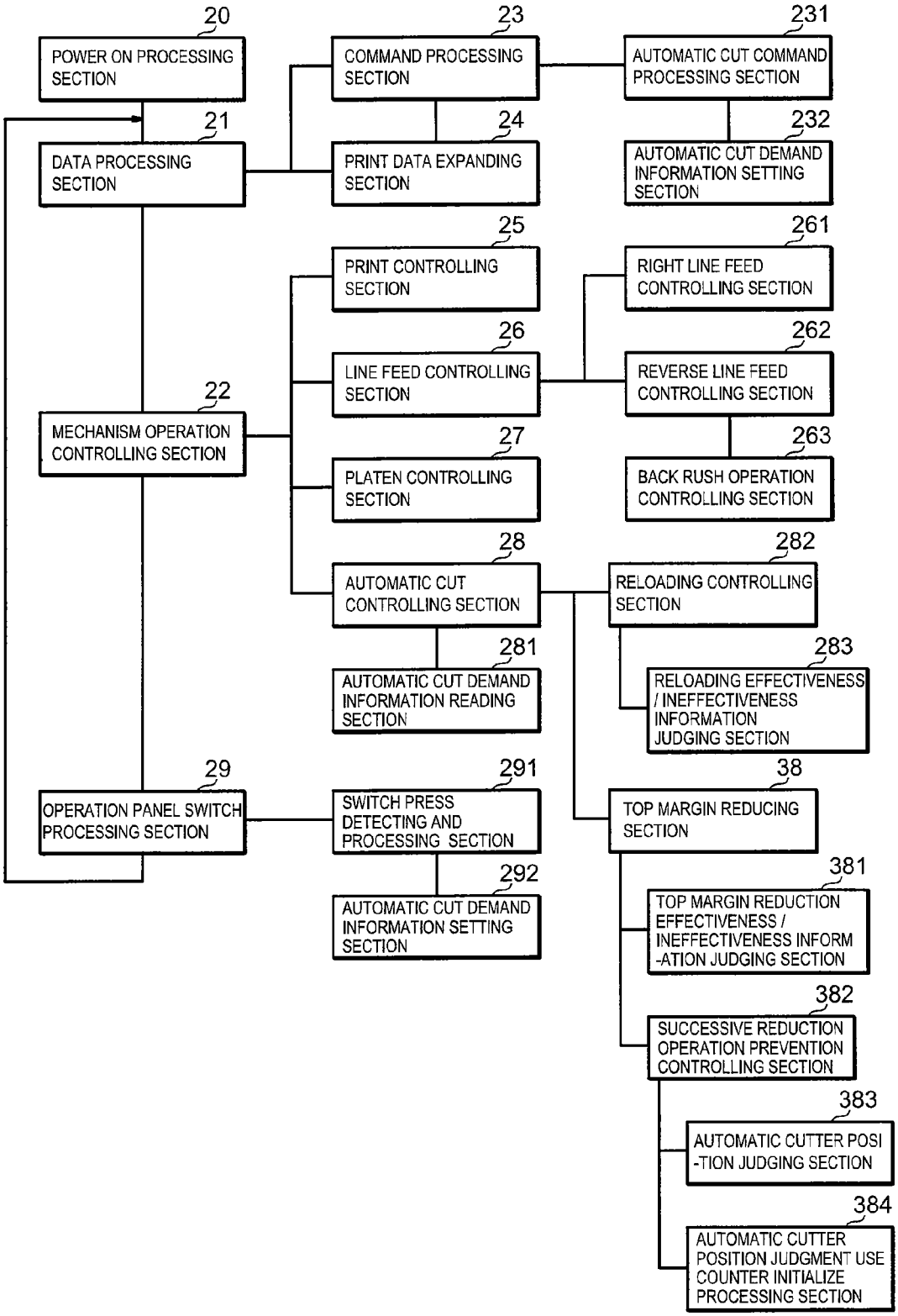
FIG. 9 is a block diagram showing a flow of a control of a printing apparatus in the third embodiment.

It is to explain a structure of the third embodiment on the basis of a block diagram showing a flow of a control of a printing apparatus in the third embodiment of FIG. 9. Moreover, with respect to the same parts as the second embodiment mentioned above, the explanation is omitted by assigning the same marks.

In FIG. 9, the top margin reducing section 38 has a successive reduction operation prevention controlling section 382 that performs a control for preventing an execution of successive top margin reduction operations, and the successive reduction operation prevention controlling section 382 has an automatic cutter position judging section 383 and an automatic cutter position judgment use counter initialize processing section 384.

Just after the top margin reducing section 38 performs the top margin reduction operation, the automatic cutter position judgment use counter initialize processing section 384 makes an initial value store in an automatic cutter position judgment use counter stored in a storing section; and just before the top margin reduction operation that is next performed by the top margin reducing section 38, the automatic cutter position judging section 383 reads out the automatic cutter position judgment use counter stored in the storing section, and then judges whether or not the top margin reduction operation is performed successively on the basis of the value.

Moreover, in the automatic cutter position judgment use counter, a position in which the roll paper 2 is cut through the automatic cutter 10 is regarded as "0", and a reverse line feed amount is stored as a negative value from the position, further a right line feed amount is stored as a positive value.

Figure 10:
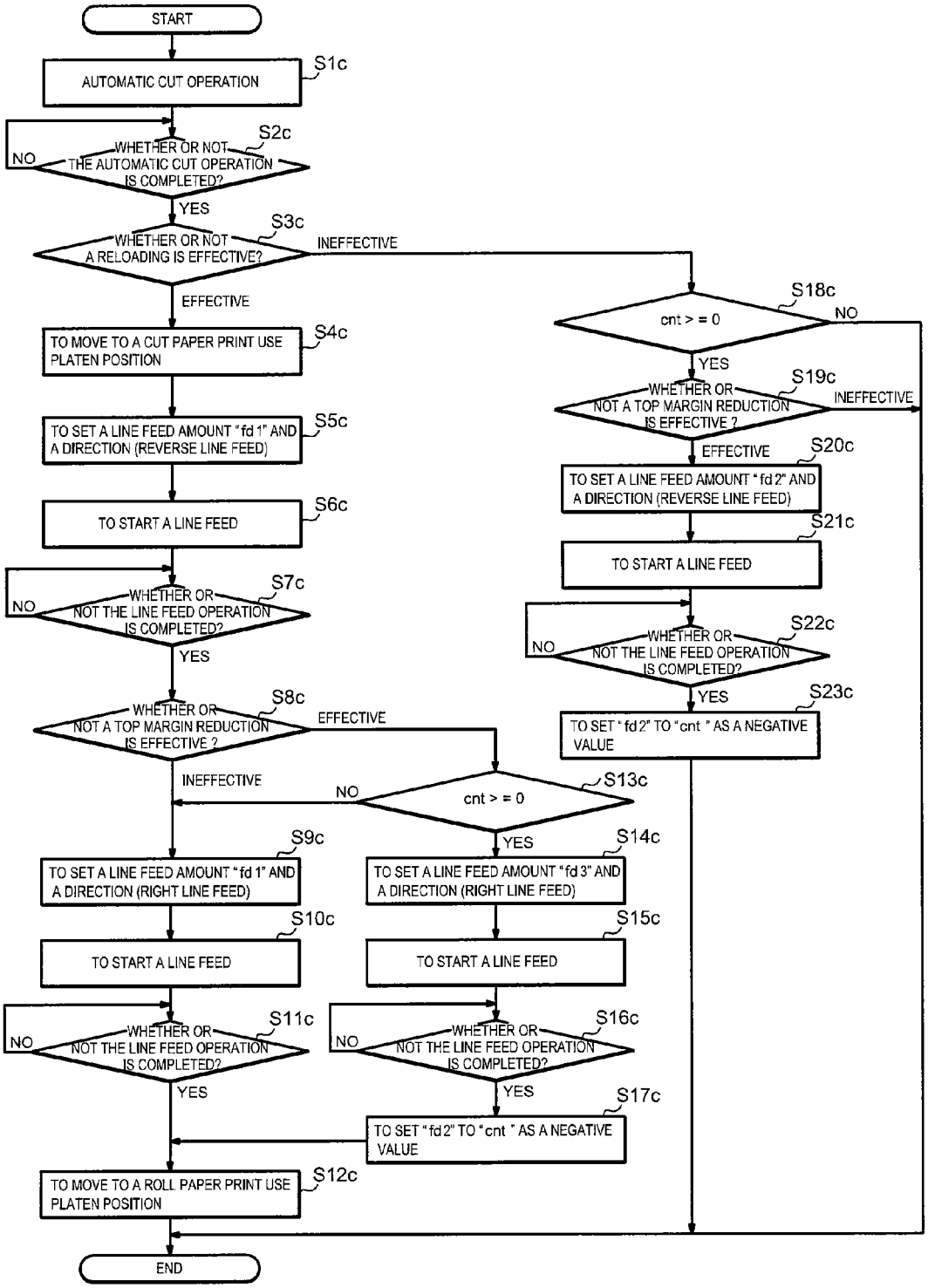
FIG. 10 is a flow chart for explaining a slack removing operation in the third embodiment.

It is to explain a function of the structure mentioned above by following steps shown by "S" of the flow chart for explaining a slack removing operation in the third embodiment of FIG. 10.

S1*c*, S2*c*: Because they are the same as S1*b* and S2*b* in the FIG. 6, the explanation is omitted.

S3*c*: After the roll paper 2 is cut, the reloading effectiveness/ineffectiveness information judging section 283 of the reloading controlling section 282 reads out and judges reloading effectiveness/ineffectiveness information stored previously in a storing section, after judged it ineffective, shifts the process to S18*c*; after judged it effective, on the other hand, shifts the process to S4*c*.

S4*c*~S12*c*: Because they are the same as S4*b*~S12*b* in the FIG. 6, the explanation is omitted.

S13*c*: After it is judged that the top margin reduction effectiveness/ineffectiveness information is effective, the automatic cutter position judging section 383 judges whether or not the automatic cutter position judgment use counter ("cnt") is a negative value, after judged it a negative value, judges that the top margin reduction operation is performed successively, and for performing the right line feed operation in which a right line feed amount is equal to a reverse line feed amount, shifts the process to S9*c*; after judged it a not a negative value, on the other hand, judges that the top margin reduction operation is performed not successively, and for performing the top margin reduction operation, shifts the process to S14*c*.

Moreover, when the automatic cutter position judgment use counter ("cnt") shows a negative value, the tip of the roll paper 2 is located between the automatic cutter 10 and the pull-up roller 9.

S14*c*, S15*c*: Because they are the same as S13*b* and S14*b* in the FIG. 6, the explanation is omitted.

S16*c*; The right line feed controlling section 261, as shown by FIG. 7C, performs the right line feed operation until the tip of the roll paper 2 reaches to the position at which it is not taken off from the pull-up rollers 9, after the right line feed operation is completed, the process is shifted to S17*c*.

S17*c*: After the top margin reduction operation is completed, the automatic cutter position judgment use counter initialize processing section 384 makes a line feed amount ("fd2") store in the automatic cutter position judgment use counter of a storing section as a negative value (initial value), and shifts the process to S12*c*.

S18*c*: In the step S3*c*, after it is judged that the reloading effectiveness/ineffectiveness information is ineffective, the automatic cutter position judging section 383 judges whether or not the automatic cutter position judgment use counter ("cnt") is a negative value, after judged it a negative value, judges that the top margin reduction operation is performed successively, and completes the process; after judged it not a negative value, judges that the top margin reduction operation is not performed successively, and shifts the process to S19*c*.

S19*c*·S21*c*: Because they are the same as S16*b*~S18*b* in FIG. 6, the explanation is omitted.

S22*c*: The reverse line feed controlling section 262, as shown by FIG. 8B, performs the reverse line feed operation until the tip of the roll paper 2 reaches to the position at which it is not taken off from the pull-up rollers 9, after the reverse line feed operation is completed, the process is shifted to S23*c*.

S23*c*: After the top margin reduction operation is completed, the automatic cutter position judgment use counter initialize processing section 384 makes a line feed amount ("fd2") store in the automatic cutter position judgment use counter of a storing section as a negative value (initial value), and completes the process.

Like this, it becomes possible to prevent a successive execution of the top margin reduction operation.

Moreover, it is possible to make the line feed amount "fd2" store in the automatic cutter position judgment use counter of a storing section as a negative value in the power on processing section 20, and make the top margin reduction operation not be performed even after a switch is pressed for starting the automatic cut of the roll paper 2 through an operator just after an electric power is thrown in.

As explained above, in the third embodiment, adding to the effects of the first embodiment and the second embodiment, an effect is obtained that can prevent that the roll paper is taken off from pull-up rollers through successively executing the top margin reduction operation, and prevent the occurrence of a paper running jam.

Embodiment 4

A fourth embodiment, even though the same print data is sent to two kinds of printing apparatuses 1 in which distances from the automatic cutter to the print head are different, enables to cut the roll papers on which the same contents are printed and give them to customers.

In the first embodiment to the third embodiment, there is a problem that a region of an necessary print result cannot be cut, in the case that the same print data are respectively sent from an upper apparatus in which the same application software is operated to two kinds of printing apparatuses 1 in which distances from the automatic cutter 10 to the printer head 7 are different, this is to solve the problem.

Figure 11:
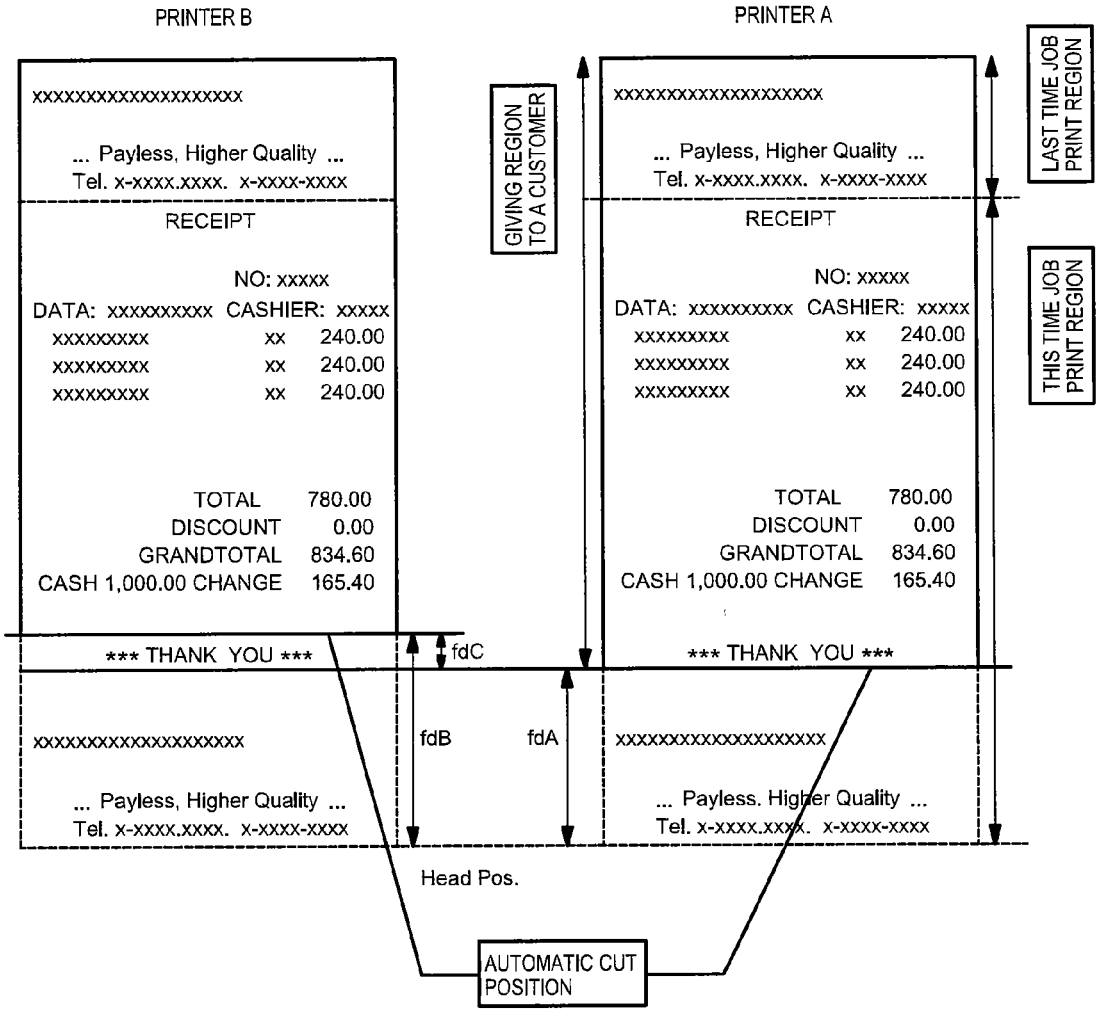
FIG. 11 is an explanation diagram of an automatic cut position adjustment in the fourth embodiment.

FIG. 11 shows an example that the same print data are sent to a printer A and a printer B those are two kinds of printing apparatuses 1 in which the distances from the automatic cutter 10 to the print head 7 are different, and automatic cutting are performed.

Data sent to the printer A and the printer B in a 1 job are shown in (a)~(e); (a)~(e) show print data and line feed data; and (e) shows an automatic cut command.

A receipt as a print result given to a customer is a print result of (d) printed in the last time job, and (a), (b) and (c) printed in this time job. The content of the last time job print region shown by FIG. 11 is always the same content such as shop information and the like, and has an effect that can reduce upper end part of the receipt by printing previously.

The data is created by adjusting to the printer A, because the roll paper 2 is cut on the automatic cut position at that time through the automatic cut command of (e) after (d) is printed, it is possible to cut on the below of the print of (c), and it becomes possible to issue the receipt that cuts a region which prints from (d) of the last time job print to "*THANK YOU*" of (c) of this time job print.

With respect to this, because the distance from the automatic cutter 10 to the print head 7 in the printer B is longer compared with that in the print A, the automatic cut position of the printer B is more close to a tip side of the roll paper 2 compared with the printer A, and there is a problem that the necessary print data (c) becomes outside of the customer giving region in the issued receipt.

Therefore, in the present embodiment, an automatic cut position adjustment is performed so as to absorb the difference "fdC" (fdC=fdB−fdA) between the distances from the automatic cutter 10 to the print head 7 in the printer A and the printer B. Moreover, "fdA" is regarded as a distance from the automatic cutter 10 to the print head 7 in the printer A; "fdB" is regarded as a distance from the automatic cutter 10 to the print head 7 in the printer B.

The automatic cut position adjustment amount "fdC" as an automatic cut position adjustment value can be inputted previously by operating an operation panel switch through an operator. For example, if the automatic cut position adjustment amount is 0, "00H" (hexadecimal number) is stored in a storing section of a non-volatile memory; if it is +1 millimeter, "01H" (hexadecimal number) is stored in the storing section of the non-volatile memory; and if it is +2 millimeter, "02H" (hexadecimal number) is stored in the storing section of the non-volatile memory.

Figure 12:
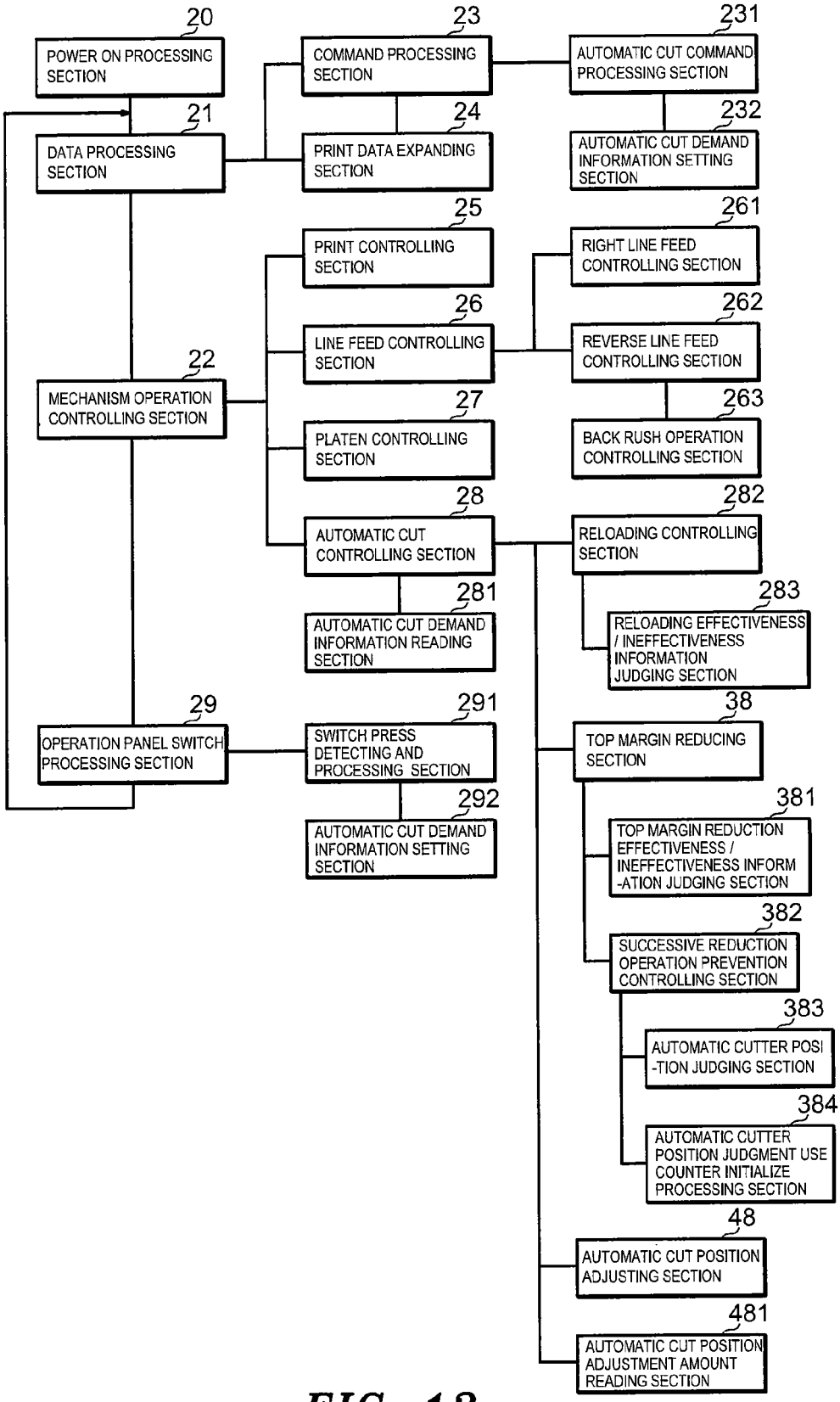
FIG. 12 is a block diagram showing a flow of a control of a printing apparatus in the fourth embodiment.

It is to explain a structure of the fourth embodiment on the basis of a block diagram showing a flow of a control of a printing apparatus in the fourth embodiment of FIG. 12. Moreover, with respect to the same parts as the third embodiment mentioned above, the explanation is omitted by assigning the same marks.

In FIG. 12, the automatic cut controlling section 28 has an automatic cut position adjusting section 48; Furthermore, the automatic cut position adjusting section 48 has an automatic cut position adjustment amount reading section 481. The automatic cut position adjusting section 48 performs a control for changing automatic cut position by performing a sending operation of the roll paper on the basis of the automatic cut position adjustment amount (cut position adjustment value) read out from a storing section by the automatic cut position adjustment amount reading section 481.

Figure 13:
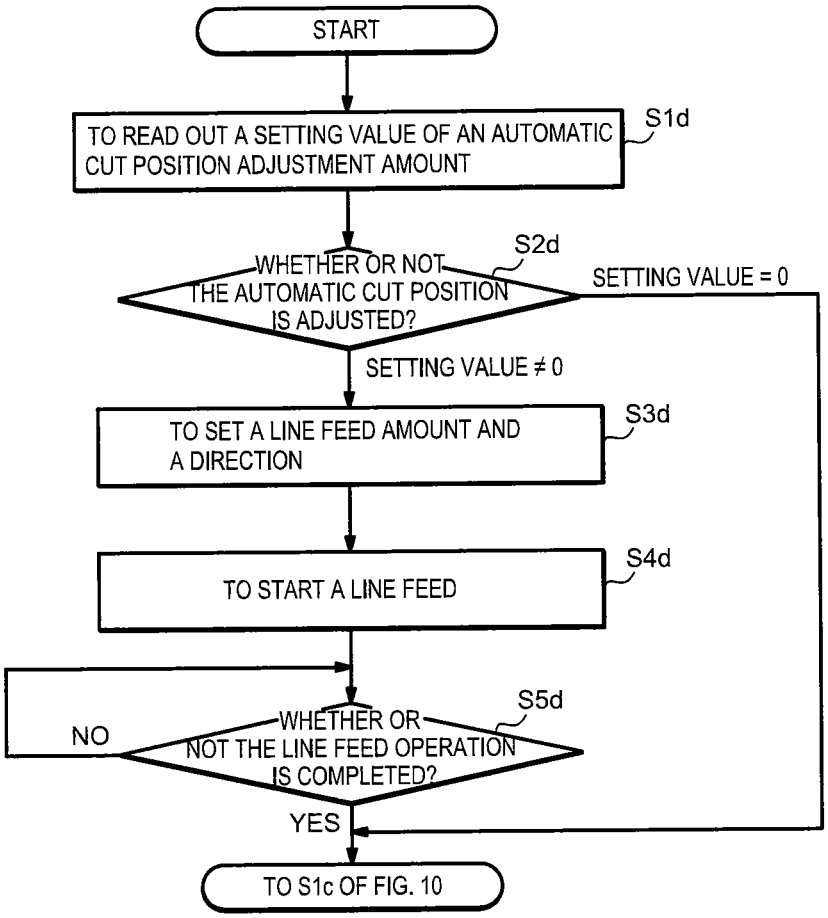
FIG. 13 is a flow chart for explaining a slack removing operation in the fourth embodiment.

It is to explain a function of the structure mentioned above by following steps shown by "S" of the flow chart for explaining a slack removing operation in the fourth embodiment of FIG. 13.

When the print job data created by adjusting to the printer A is being sent to the printer B, if the difference "fdC" ("fdB−fdA") between the distances from the automatic cutter 10 to the print head 7 in the printer A and the printer B is +2 millimeter, the automatic cut position adjustment amount is previously set into +2 millimeter through a menu function and the like (not shown) through an operator such as a system manager and the like in the case to set the present printer B as a printing apparatus 1. Through this operation, "02H" is stored as an automatic cut position adjustment amount in a storing section of a non-volatile memory.

S1*d*: The automatic cut position adjustment amount reading section 481 reads out the automatic cut position adjustment amount ("02H") stored in a storing section.

S2*d*: The automatic cut position adjusting section 48 judges the read out automatic cut position adjustment amount, shifts the process to S1*c* by regarding that the automatic cut position adjustment is unnecessary, if it is judged that the automatic cut position adjustment amount is 0; and shifts the process to S3*d* by regarding that the automatic cut position adjustment is necessary, on the other hand, if it is judged that the automatic cut position adjustment amount is not 0.

S3*d*: The automatic cut position adjusting section 48 converts the read out automatic cut position adjustment amount ("02H") into a line feed amount that is a unit that the line feed controlling section 26 can feeds lines, and makes the line feed amount store in a storing section. Further, if the value of the automatic cut position adjustment amount is negative, reverse direction is stored in the storing section; and if it is positive, right direction is stored in the storing section. In the present embodiment, because the value of the automatic cut position adjustment amount is positive, right direction is stored in the storing section.

S4*d*: The line feed controlling section 26 feeds lines in the roll paper 2 on the basis of the line feed amount and the direction that are stored in the storing section.

S5*d*: After the line feed controlling section 26 completes the line feed operation, the process is shifted to S1*c*.

Moreover, it is to explain a process of S1*c* in the present embodiment hereinafter.

S1*c*: The print operation and the automatic cut position adjustment operation of the roll paper 2 are completed, on a condition that the printed part goes beyond the automatic cutter 10, the printing apparatus 1 receives the automatic cut command from an upper apparatus, or a switch is pressed for starting the automatic cut through an operator, then the automatic cut demand information is stored in a storing section.

The automatic cut demand information reading section 281 of the automatic cut controlling section 28 reads out the automatic cut demand information stored in the storing section, starts an operation for cutting the roll paper 2 through the automatic cutter 10 by driving a driving means, and shifts the process to S2*c*.

Because those after S2*c* are the same as the third embodiment, the explanation is omitted.

Through performing the automatic cut position adjustment like this, even though the same print data is sent to two kinds of printing apparatuses 1 in which distances from the automatic cutter to the print head are different, it is possible for respective printing apparatuses to cut the roll papers on which the same contents are printed and give them to customers As explained above, in the fourth embodiment, adding to the effects of the first embodiment to the third embodiment, an effect is obtained that can cut the roll papers on which the same contents are printed and give them to customers even though the same print data are sent to printing apparatuses in which the measures of mechanism sections are different.

Moreover, in the second embodiment to the fourth embodiment, it is possible to judge that it is any one of the 1P paper or 2P paper by detecting paper pressure of the roll paper 2 through a paper pressure detection mechanism (not shown), when it is judged that it is 2P paper, the reloading may also be regarded as effective.

Further, in the second embodiment to the fourth embodiment, the reloading operation may also be performed per print of a fixed length (for example, 1 meter).

The present invention is not limited to the foregoing embodiments but many modifications and variations are possible within the spirit and scope of the appended claims of the invention.

What is claimed is:

1. A printing apparatus that has a paper cut mechanism for cutting copying paper printed in a print mechanism, the printing apparatus comprising:

a first conveying section which holds and sends out the copying paper to the print mechanism;

a second conveying section which holds and sends out the copying paper that is printed in the print mechanism and is sent out from the first conveying section to the paper cut mechanism in a conveying direction, the printing apparatus arranged along the conveying direction with the first conveying section, the print mechanism, the second conveying section and the paper cut mechanism;

a holding section which holds previously one of a first setting value and a second setting value connected with convening control of the copying paper after being cut;

a judging section which judges whether a setting value is the first setting value or the second setting value in the holding section; and a controlling section which returns an initial tip of the copying paper after being cut by the paper cut mechanism in a reverse direction to a position proximate the second conveying section and waits for print at a position being not past the print mechanism when the judging section judges to the first setting value in the holding section and which returns the initial tip of the copying paper after being cut by the paper cut mechanism in a reverse direction proximate the first conveying section being past the print mechanism and thereafter conveys in a conveying direction to a position proximate the second conveying section past the print mechanism and waits for an additional print at the position when the judging section judges the second setting value in the holding section.

2. The printing apparatus according to claim 1, wherein the controlling section stores a distance between the print mechanism and the paper cut mechanism, which defines a cut position adjustment value, the cut position adjustment value being stored in a storing section of the controlling section, the paper cut mechanism cutting the copying paper based at least in part on a reading of the cut position adjustment value.

3. The printing apparatus according to claim 2, further comprising a menu function associated with the controlling section for setting the cut position adjustment value into the storing section.

4. The printing apparatus according to claim 1, wherein the controlling section further sends out information related to the initial tip and a second tip of the copying paper to the second conveying section.

5. The printing apparatus according to claim 4, wherein the controlling section stores a distance between the print mechanism and the paper cut mechanism, which defines a cut position adjustment value, the controlling section storing the cut position adjustment value in a storing section and conveying the copying paper based at least in part on the basis of the cut position adjustment value.

6. The printing apparatus according to claim 4, wherein the copying paper is subsequently sent in the conveying direction toward the second conveying section by the controlling section after the second tip is returned to a position between the print mechanism and the first conveying section.

7. The printing apparatus according to claim 1, wherein the controlling section moves a second tip of the copying paper so that a movement amount of the second tip of the copying paper in the conveying direction from the first conveying section to between the print mechanism and the first conveying section defines a sending feed amount, the sending feed amount is less than the return feed amount.

8. The printing apparatus according claim 7, wherein the controlling section, stores a distance between the print mechanism and the paper cut mechanism, which defines a cut position adjustment value, the controlling section conveying the copying paper on the basis of the cut position adjustment value, the cut position adjustment value being stored in a storing section of the controlling section, the paper cut mechanism cutting the copying paper based at least in part on the cut position adjustment value.

9. The printing apparatus according to claim 1, wherein a sending feed amount, which is defined as a movement amount of the initial tip of the copying paper in the conveying direction from the first conveying section to between the print mechanism and the first conveying section, is less than the return feed amount.

10. The printing apparatus according to claim 9, wherein the controlling section, stores a distance between the print mechanism and the paper cut mechanism, which defines a cut position adjustment value, the controlling section conveying the copying paper based at least in part on the basis of the cut position adjustment value, the cut position adjustment value being stored in a storing section of the controlling section, the paper cut mechanism cutting the copying paper based at least in part on the cut position adjustment value.

11. The printing apparatus according to claim 1, wherein the copying paper is comprised of two or more pieces of copying paper overlapped.

12. The printing apparatus according to claim 1, wherein the controlling section sends the initial tip in the conveying direction when the copying paper is sent to the print mechanism.

13. The printing apparatus according to claim 1, wherein the controlling section further includes an effectiveness/ineffectiveness judging section for judging effectiveness of a reloading operation, the reloading operation comprised at least partially of moving the second tip in the reverse direction to the original position.

14. The printing apparatus according to claim 1, wherein the controlling section performs a reloading operation each time the copying paper is cut by the cut mechanism, wherein the reloading operation is comprised at least partially of moving an additional tip of the copying paper in the reverse direction to the original position.

15. The printing apparatus according to claim 1, wherein the controlling section further includes an effectiveness/ineffectiveness judging section for judging effectiveness of a reloading operation, wherein the effectiveness/ineffectiveness judging section is set based on a type of the copying paper.

16. The printing apparatus according to claim 1, wherein the controlling section performs a reloading operation based on a fixed length of the copying paper.

17. The printing apparatus according to claim 1, wherein the first setting value and the second setting value is set to the holding section by a menu function of apparatus.

18. The printing apparatus according to claim 1, wherein the first setting value and the second setting value indicate a classification of medium, the first setting value is roll paper, the second setting value is copy roll paper.

19. The printing apparatus according to claim 1, wherein when the holding section is set the second setting value, it performs the reloading operation per print of a fixed length.

* * * * *